US005873643A

United States Patent [19]

Burgess, Jr. et al.

[11] Patent Number: 5,873,643

[45] Date of Patent: Feb. 23, 1999

[54] MULTI-COMPARTMENT CABINET

[76] Inventors: Joseph Burgess, Jr., 4500 Lantern Pl., Alexandria, Va. 22306; John Cleveland Anderson, Jr., 1809 Hylton Ave., Woodbridge, Va. 22191; Johnny Derrick Wilson, 3720 Madison La., Falls Church, Va. 22041

[21] Appl. No.: 905,771

[22] Filed: Aug. 4, 1997

Related U.S. Application Data

[60] Provisional application No. 60/032,131, Dec. 10, 1996.

[51] Int. Cl.[6] ..... B65D 25/16

[52] U.S. Cl. ..... 312/290; 312/351; 312/249.11; 220/404

[58] Field of Search ..... 312/351, 290, 312/249.8, 249.11, 293.1, 293.2, 327, 328; 220/404, 403, 462, DIG. 909

[56] References Cited

U.S. PATENT DOCUMENTS

| | | | |
|---|---|---|---|
| D. 312,159 | 11/1990 | Martin . | |
| D. 313,684 | 1/1991 | Ray . | |
| D. 319,519 | 8/1991 | Keir . | |
| D. 324,442 | 3/1992 | Metzger . | |
| D. 324,748 | 3/1992 | Bagamery . | |
| D. 324,750 | 3/1992 | Tocci et al. . | |
| D. 327,760 | 7/1992 | Donnelly . | |
| D. 327,965 | 7/1992 | Chelec . | |
| D. 329,313 | 9/1992 | Ward et al. . | |
| D. 332,676 | 1/1993 | Benson . | |
| D. 335,012 | 4/1993 | Broussard . | |
| D. 340,333 | 10/1993 | Duran et al. . | |
| D. 370,105 | 5/1996 | Piner . | |
| 2,868,606 | 1/1959 | Stierna | 312/293.2 |
| 2,895,782 | 7/1959 | Fragale | 312/290 |
| 3,421,689 | 1/1969 | Reinzan | 312/290 X |
| 4,057,309 | 11/1977 | Fragale | 312/290 |
| 4,811,996 | 3/1989 | Hansson . | |
| 4,925,056 | 5/1990 | McCoig | 220/404 |
| 4,964,523 | 10/1990 | Bieltvedt et al. . | |
| 5,103,998 | 4/1992 | Caro et al. . | |
| 5,119,958 | 6/1992 | Gabert et al. | 220/404 |
| 5,174,468 | 12/1992 | Holderman | 220/404 X |
| 5,238,139 | 8/1993 | Bisceglia . | |
| 5,284,268 | 2/1994 | Marsan et al. . | |
| 5,390,813 | 2/1995 | Anderson et al. . | |
| 5,398,838 | 3/1995 | Dosunmu . | |
| 5,458,350 | 10/1995 | Johnson et al. . | |

FOREIGN PATENT DOCUMENTS

| | | | |
|---|---|---|---|
| 685156 | 7/1930 | France | 312/290 |

*Primary Examiner*—Peter M. Cuomo
*Assistant Examiner*—Hanh V. Tran
*Attorney, Agent, or Firm*—Richard C. Litman

[57] ABSTRACT

The present invention is a cabinet having multiple compartments for storing and sorting articles, such as recyclables, laundry, toys, trash, etc. Vertical slots are provided in the front and rear walls of the cabinet for the insertion of dividing panels to thereby adjust the number and size of compartments. Cleats are provided on the interior of the cabinet, and on the panels for holding the handles or drawstrings of plastic or cloth bags. A bottom drawer is located on the front of the cabinet. The drawer can store extra bags for future use, and is also large enough to store any unused panels. The top of the cabinet includes three covers for access to the compartments. The drawer and covers are provided with knobs to aid in opening the drawer and covers. Two of the vertical slots are located between the covers. This configuration allows access to one of the compartments at a time when the panels are placed in these two slots. When additional panels are used each cover can provide access to more than one compartment depending on the placement of the panels. Optionally, four castors can be provided on the bottom of the cabinet to allow easy movement from one location to the next. With the exception of hardware, hinges and the castors, the entire cabinet can be made of wood for aesthetic purposes. Other materials such as plastic, metal, press-board, laminates, etc., can be used depending on the preferred cost or appearance.

6 Claims, 5 Drawing Sheets

MULTI-COMPARTMENT CABINET

CROSS REFERENCE TO RELATED APPLICATIONS

This application claim the benefit of U.S. Provisional Application Ser. No. 60/032,131 filed Dec. 10, 1996.

BACKGROUND OF THE INVENTION

1. Field of the Invention

The present invention relates to a multi-compartment cabinet having movable panels, cleats to hold plastic bags by their handles, and a drawer to store unused bags and panels.

2. Description of Prior Art

There are a number of prior art devices that provide a means to hold plastic trash bags in place. Additionally, there are prior art trash containers with a means to vary the number of compartments located therein. Although an exemplary inventory of trash bag holders follow describing various individual features, none of the prior art devices provide the combination of means for varying the number of compartments, a number of cleats to hold plastic bags by their handles, and a drawer to store unused panels and bags.

In its simplest form, some trash holders a dedicated to a predetermined number of units for receiving trash. U.S. Design Pat. No. 312,159, issued on Nov. 13, 1990 to Richard P. Martin, shows a multi-drawered trash receptacle without means to vary the number of compartments. U.S. Design Pat. No. 335,012, issued on Apr. 20, 1993 to Norman J. Broussard, discloses a three compartment cabinet having three separate top covers. U.S. Design Pat. No. 340,333, issued on Oct. 12, 1993 to Richard S. Duran et al., discloses a four compartment recycling cabinet. U.S. Design Pat. No. 370,105, issued on May 21, 1996 to Jackie L. Piner, discloses a multi-compartment trash and recyclable material receptacle. U.S. Design Pat. No. 313,684, issued on Jan. 8, 1991 to Deborah Ray, discloses a seven compartment trash receptacle which does not include means to vary the number of compartments. U.S. Design Pat. No. 332,676, issued on Jan. 19, 1993 to Stephen P. Benson, discloses a multi-compartment trash receptacle which does not include means to vary the number of compartments. U.S. Design Pat. No. 324,750, issued on Mar. 17, 1992 to Louis Tocci et al., discloses a three compartment trash receptacle which does not include means to vary the number of compartments. U.S. Pat. No. 5,398,838, issued on Mar. 21, 1995 to Razak A. Dosunmu, discloses a five compartment trash and recycling container which does not include means to vary the number of compartments.

Another group of inventions allow removal of rigid compartment liners, but are still dedicated in number. U.S. Design Pat. No. 319,519, issued on Aug. 27, 1991 to Gary Keir is entitled a waste can with removable compartments for recycling. U.S. Design Pat. No. 327,760, issued on Jul. 7, 1992 to Gerald E. Donnelly, discloses a four compartment trash receptacle which does not include means to vary the number of compartments, but allows removal of a rigid liner. U.S. Design Pat. No. 329,313, issued on Sep. 8, 1992 to Patrick Ward et al., discloses a similar changeable multi-compartment trash receptacle.

Another group of patents include holders with bag handle holding means for flexible bags, but which do not include means to vary the number of compartments. For example, U.S. Design Pat. No. 324,442, issued on Mar. 3, 1992 to Judith M. Metzger, discloses a four compartment trash receptacle having hooks in at least one compartment. U.S. Design Pat. No. 327,965, issued on Jul. 14, 1992 to Richard J. Chelec, discloses a multi-compartment trash receptacle having three separate lids with hooks in at least one compartment. U.S. Design Pat. No. 324,748, issued on Mar. 17, 1992 to Alan K. Bagamery, discloses a wire-type bag holder for a grocery store style handled plastic bag.

Several patents further disclose means directed toward customizing compartments. U.S. Pat. No. 5,103,998, issued on Apr. 14, 1992 to Dolly Caro et al., discloses a multi-compartment recycling receptacle having slots for receiving panels to thereby adjust the compartment sizes. U.S. Pat. No. 5,238,139, issued on Aug. 24, 1993 to Robert D. Bisceglia, discloses a receptacle for sorting recyclables having means to vary the number of bags suspended in the receptacle.

Others focus on holders for segmenting specific types of refuse. U.S. Pat. No. 4,964,523, issued on Oct. 23, 1990 to Arnor Bieltvedt et al., discloses a two compartment trash receptacle with first and second access openings for passing recyclable and non-recyclable trash. U.S. Pat. No. 5,284,268, issued on Feb. 8, 1994 to Normand Marsan et al., discloses a recycling container for segregating recyclable paper from trash, having a removable bin and a chute leading to the bin. U.S. Pat. No. 5,390,813, issued on Feb. 21, 1995 to Dennis C. Anderson et al., discloses a side by side, two compartment recycling container formed from plastic resin for holding conventional plastic bag held therein. U.S. Pat. No. 5,458,350, issued on Oct. 17, 1995 to James I. Johnson et al., discloses a three compartment collector dolly for recyclable materials such as newspaper.

None of the above inventions and patents, taken either singularly or in combination, is seen to describe the instant invention as claimed. Thus a multi-compartment cabinet having the combined aforementioned features is desired.

SUMMARY OF THE INVENTION

The present invention is a cabinet having multiple compartments for storing and sorting articles, such as recyclables (glass, aluminum, paper, etc.), laundry, toys, trash, etc. Vertical slots are provided in the front and rear walls of the cabinet for the insertion of dividing panels to thereby adjust the number and size of compartments. Cleats are provided on the interior of the cabinet and on the panels for holding the handles of plastic bags or drawstrings of plastic or cloth bags.

A bottom drawer is located on the front of the cabinet. The drawer can store extra bags for future use, and is also large enough to store any unused panels. The top of the cabinet includes three covers for access to the compartments. The drawer and covers are provided with knobs to aid in removing the tops and opening the drawer.

Two of the vertical slots are located between the covers. This configuration allows access to one of the compartments at a time when the panels are placed in these two slots. When additional panels are used each cover can provide access to more than one compartment depending on the placement of the panels.

Optionally, four castors can be provided on the bottom of the cabinet to allow easy movement from one location to the next. With the exception of hardware, hinges and the castors, the entire cabinet can be made of wood for aesthetic purposes. The cabinet may be made of other materials, such as plastic, metal, pressboard, laminates, etc., depending on the preferred cost or appearance.

Accordingly, it is a principal object of the invention to provide a device for attractively sorting and storing different materials, such as recyclables, laundry, toys, trash, etc., in bags with handles or drawstrings.

It is another object of the invention to provide a convenient method of sorting and storing various items.

It is a further object of the invention to provide a storage cabinet with an adjustable number and size of compartments.

Still another object of the invention is to provide a cabinet that can easily be moved from one location to another.

It is an object of the invention to provide improved elements and arrangements thereof in a multi-compartment cabinet for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
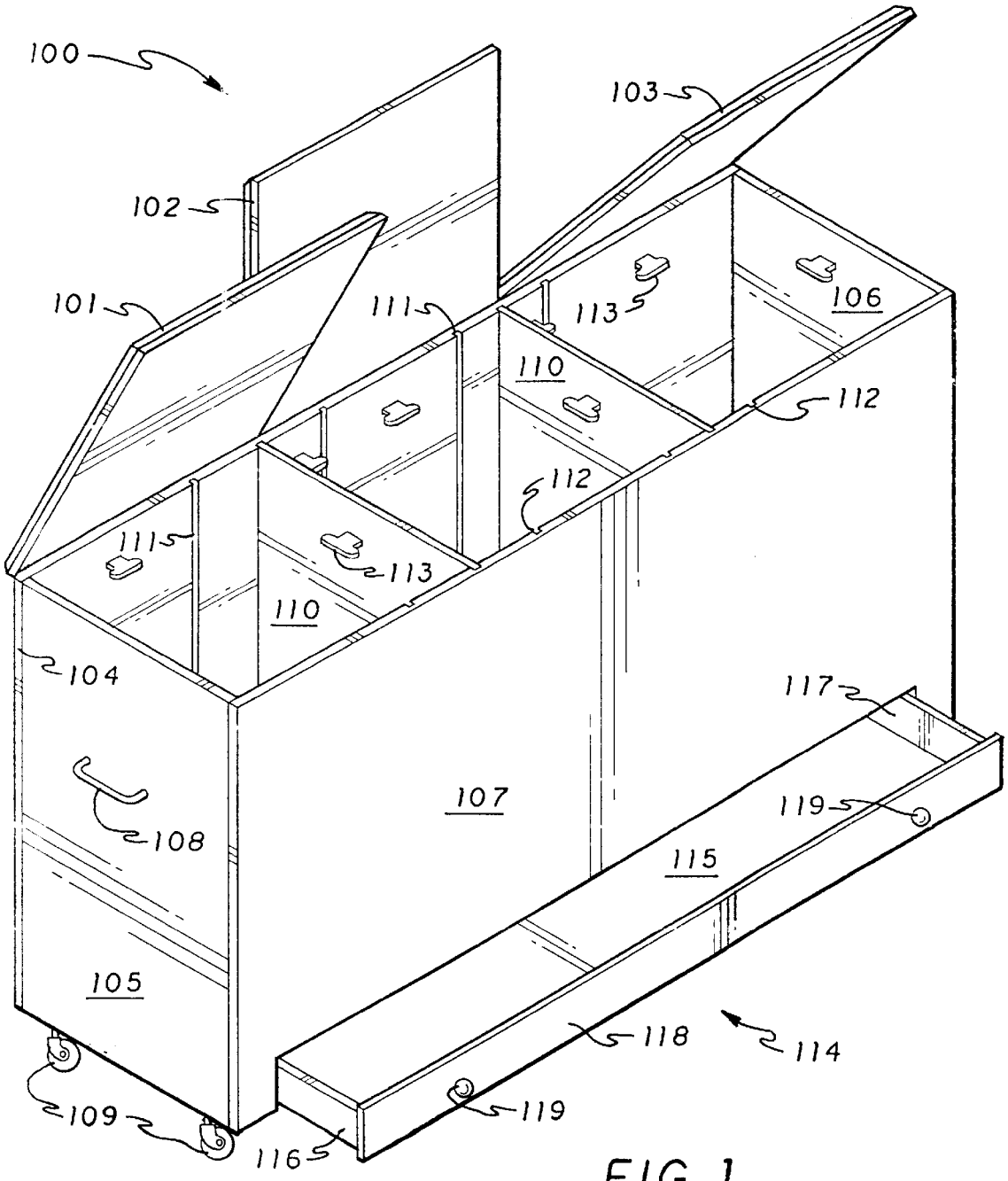
FIG. 1 is a perspective view of a multi-compartment cabinet according to the present invention.
Figure 2:
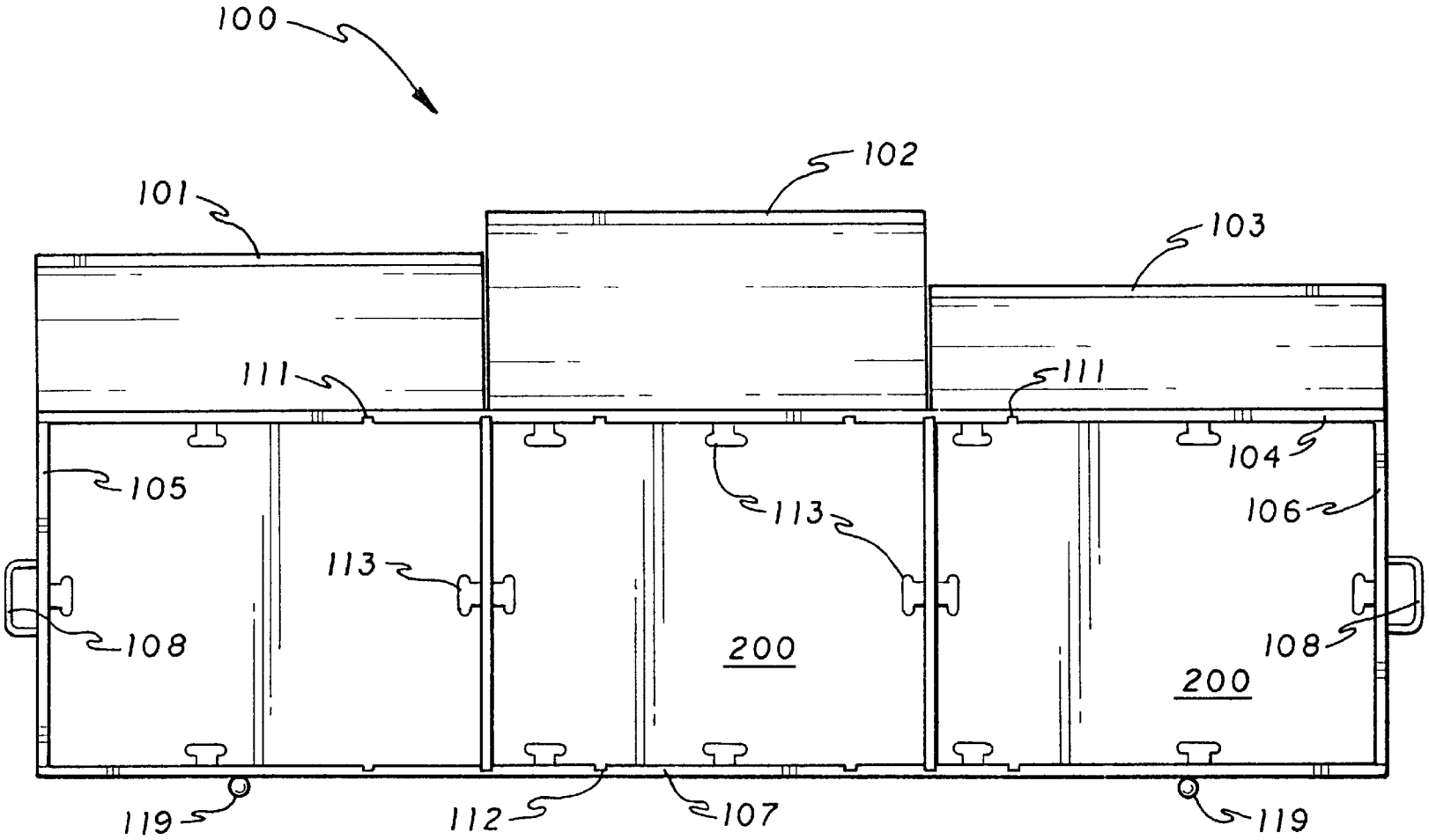
FIG. 2 is a top view of the multi-compartment cabinet shown in FIG. 1.
Figure 3:
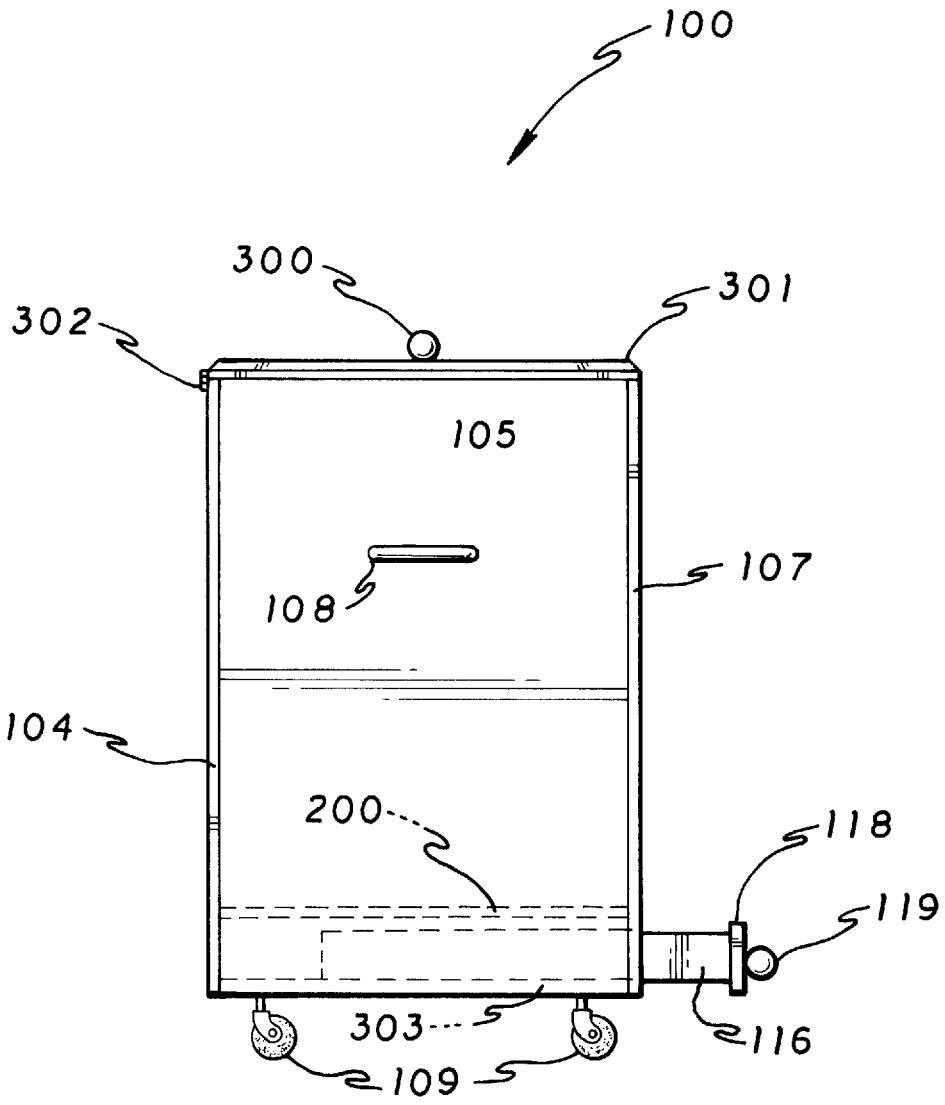
FIG. 3 is a left side view of the multi-compartment cabinet shown in FIG. 1, the right side being a mirror image thereof.

The present invention is a multi-compartment cabinet 100 as shown in FIGS. 1–3. The cabinet 100 includes a rear board 104, a front board 107, a left side board 105, a right side board 106, and a bottom board 303. Three top covers 101, 102 and 103 are optionally attached to rear board 104 using standard hinges 302. When hinges are not used, each of the top covers has a ball shaped handle 300 attached approximately in the center thereof to aid in removing the covers, although different shaped handles can be used to match any existing decor. In addition, all four top edges of each top cover include a bevel 301. While three covers are shown, the cabinet 100 may only have one large cover or the top can be covered by two, four, five, six or even seven covers, if desired. For aesthetic purposes, the number of tops is preferably equal to the number of compartments into which the cabinet would normally be divided. All of the covers can be removable, using quick disconnect hinges in place of standard hinges 302.

Near the bottom of the front of the cabinet 100 is a drawer 114 which is slidingly fitted in the bottom of the cabinet 100, and includes a bottom board 115, side boards 116 and 117, and a front board 118. The drawer 114 may also include support rails as is well known in the art. The front board 118 has two ball shaped handles 119 attached on either side, and as with handles 300, different shaped handles can be used to match any existing decor. Although it is preferred that all five handles match, different handles can be used depending on individual taste. Above the drawer 114, in the interior of the cabinet 100, is a second bottom board 200 that prevents articles placed in the compartments from falling into the drawer 114.

A number of slots 111 are formed on an interior surface of rear board 104, and opposed mating slots 112 are formed on an interior surface of front board 107. Panels 110 are provided to divide the cabinet into several compartments. While FIGS. 1 and 2 show only two panels 110 in use, up to six panels can be inserted into the six mating pairs of slots to divide the cabinet into seven compartments. Any unused panels 110 are stored in drawer 114. Slots 111 and 112, and panels 110 extend vertically from the top edge of the cabinet boards 104–107, to the top surface of second bottom board 200. The lateral placement of slots 111 and 112 is at intervals wherein usable size compartments are formed by placing panels 110 in the slots. The number of top covers installed on the cabinet, three being preferable, may affect the placement of slots 111 and 112. For instance, when three equal sized top covers are used, for aesthetic purposes, two pairs of the slots are formed at the point where two covers abut, as can be seen by FIG. 1 and 2. If two top covers are used, then for aesthetic purposes, a pair of the slots would be formed at the mid-point of the cabinet 100.

The bottom corners of the cabinet may include castors 109 to assist in rolling the cabinet 100 from one location to another. Two handles 108 are attached to side boards 105 and 106 for assisting in moving the cabinet 100 either by rolling, or lifting the cabinet 100 over uneven surfaces, or when castors 109 are not provided.

Figure 4:
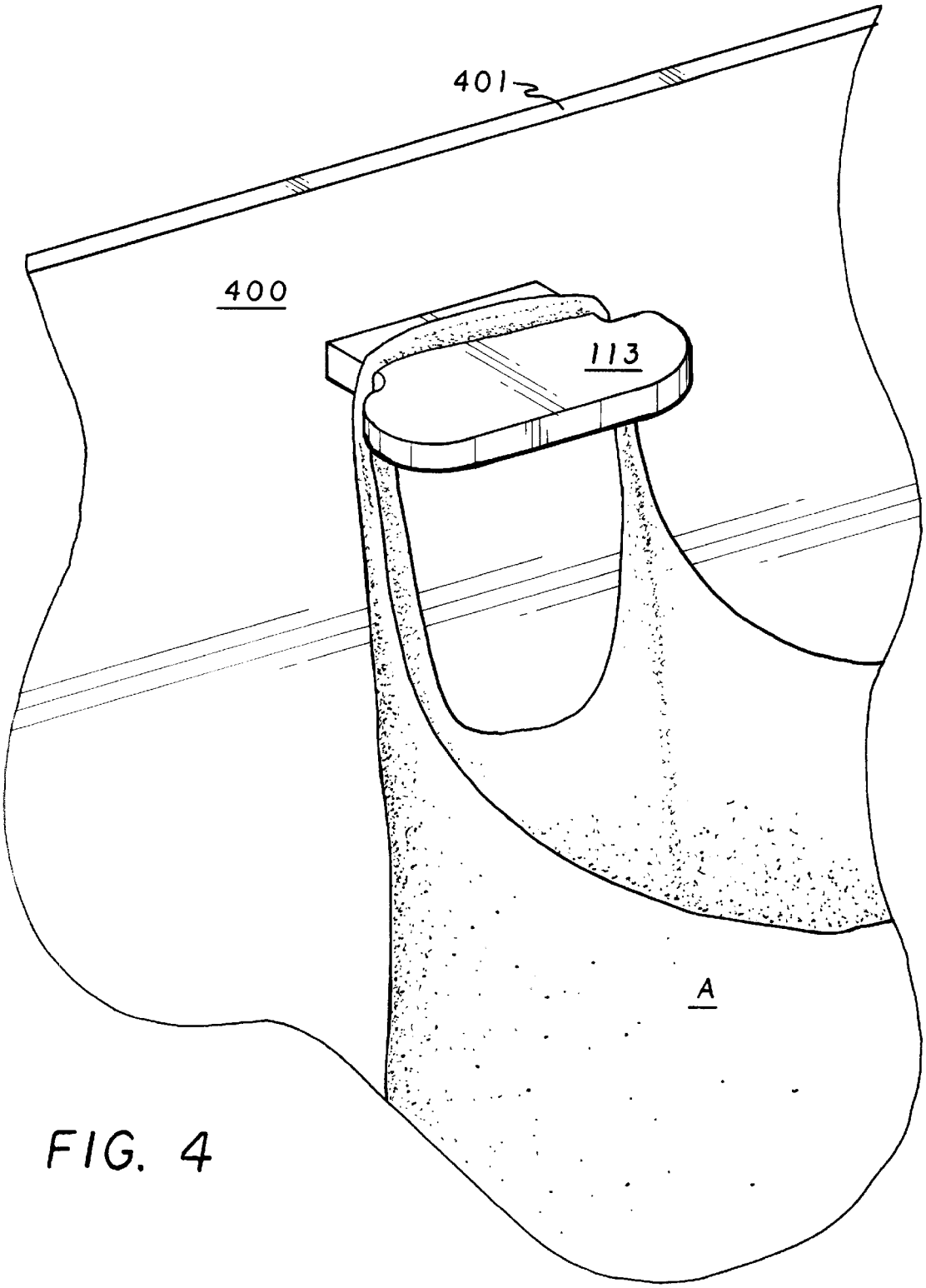
FIG. 4 is an enlarged view of one of the bag holding cleats showing how the handle of a bag is held in place by the cleat.

As is best seen in FIG. 2, regardless of the number of compartments into which the cabinet 100 is divided, each of the compartments has at least two bag holding cleats 113. The cleats are provided on the interior of the cabinet and on the panels for holding the handles of plastic bags or drawstrings of plastic or cloth bags. FIG. 4 provides a closeup view of the operation of one of the cleats 113. A bag A has a handle formed on each side of the bag A. Each cleat 113 has an enlarged portion at its distal end, and a narrow inner portion that is attached to the cabinet board 400 at its proximate end. Board 400 can be rear board 104, front board 107, left side board 105, right side board 106, or on either side of one of the panels 110. The cleats 113 are mounted one to three inches below the top edge 401 of the board, which is low enough to avoid interfering with the top covers 101, 102 and 103, yet high enough to allow bag A to hang inside the compartment. Unused bags may be stored in the drawer 114 with any unused panels 110.

Figure 5:
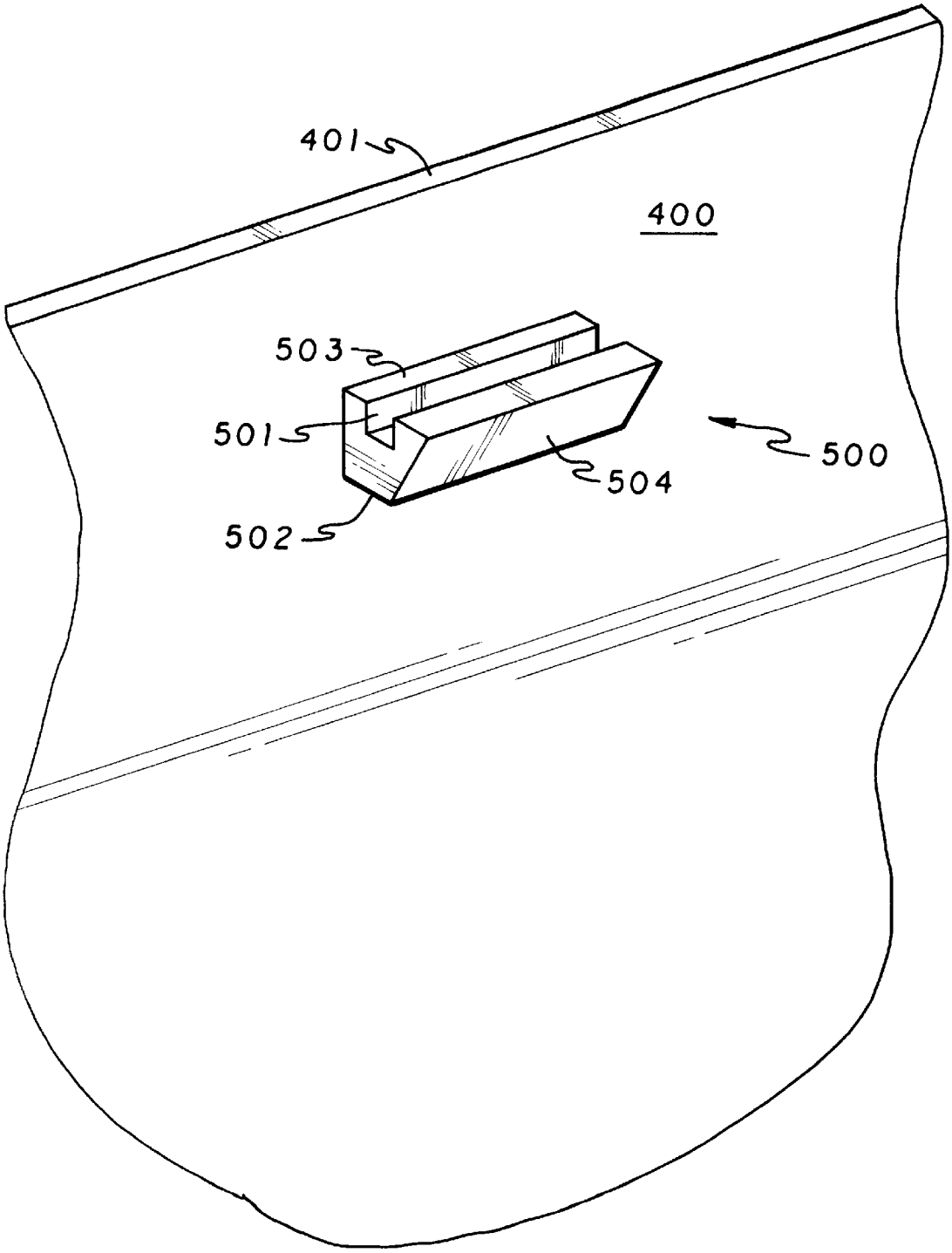
FIG. 5 is an enlarged view of a second embodiment of the bag holding cleats.

FIG. 5 shows a second, preferred embodiment of a bag holding cleat 500. Cleat 500 is mounted in a similar position to cleat 113 as shown in FIG. 4. A groove 501 is formed in a top surface 503 of cleat 500, and groove 501 accepts a handle or a drawstring of a bag to hold the bag in an open position. The length of cleat 500 is sized large enough to hold the bag as open as possible, while still being small enough to allow the bag's handle or drawstring to fit around cleat 500. A bottom surface 502 of cleat 500 is substantially smaller in depth than top surface 503. This results in a slanted outer surface 504 that makes removal of the bag easier as the bag passes by cleat 500.

It should be noted that while the cabinet 100 has been described with the use of bags in each of the compartments, the cabinet 100 may also be used without cleats 113 or 500. If the cabinet 100 is used to sort and store easily removable and relatively clean items, such as toys, laundry, etc., bags may not be required, and the items can be stored directly in the compartments.

It is to be understood that the present invention is not limited to the embodiments described above, but encompasses any and all embodiments within the scope of the following claims.

We claim:

1. A multi-compartment cabinet for use with at least one bag having a first and second handle, comprising:

a front board having inner and outer planar surfaces, a rear board having inner and outer planar surfaces, a left side board having inner and outer planar surfaces, a right side board having inner and outer planar surfaces, and a first bottom board having upper and lower planar surfaces, each of said boards attached to one another to define a walled assembly having a chamber with an upwardly opening mouth and a floor defined by said first bottom board, said inner surfaces of said front board and said rear board including a plurality of vertically aligned slots;

three top covers hingedly attached to said rear board for covering said mouth, each of said three top covers having top and bottom surfaces;

removable divider panels, each having first and second planar surfaces, each of said removable divider panels engaging one of said vertically aligned slots on said front board and said rear board to segregate said walled assembly into at least two varying sized compartments;

a plurality of bag holding cleats mounted onto said inner surfaces of said front board and said rear board a bag holding cleat mounted onto said left side board, a bag holding cleat mounted onto said right side board and at least one bag cleat mounted onto one of said removable divider panels such that each of said at least two varying sized compartments contains at least two of said bag holding cleats; and a bottom drawer slidingly disposed in close proximity over said upper surface of said first bottom board, said bottom drawer dimensioned to store at least one of said removable divider panels when not in use.

2. The multi-compartment cabinet as defined in claim 1, wherein:

said bottom drawer includes a front board and a knob mounted thereto to assist in opening said bottom drawer.

3. The multi-compartment cabinet as defined in claim 1 wherein:

said removable divider panels includes at least two removable divider panels; and said at least two removable divider panels divide said walled assembly into at least three compartments when said at least two panels are each inserted into a pair of said vertically aligned slots.

4. The multi-compartment cabinet as defined in claim 1 wherein said first bottom board has four casters mounted thereto for supporting said cabinet.

5. The multi-compartment cabinet as defined in claim 1 wherein each of said top covers has a handle mounted thereon.

6. The multi-compartment cabinet as defined in claim 1 wherein said multi-compartment cabinet is made from plastic.

* * * * *